US007771251B2

(12) United States Patent
Muldowney

(10) Patent No.: US 7,771,251 B2
(45) **Date of Patent: *Aug. 10, 2010**

(54) THREE-DIMENSIONAL NETWORK FOR CHEMICAL MECHANICAL POLISHING

(75) Inventor: Gregory P. Muldowney, Earleville, MD (US)

(73) Assignees: Rohm and Haas Electronic, Newark, DE (US); Electronic Materials CMP Holding, Inc., Newark, DE (US)

( * ) Notice: Subject to any disclaimer, the term of this patent is extended or adjusted under 35 U.S.C. 154(b) by 19 days.

This patent is subject to a terminal disclaimer.

(21) Appl. No.: 12/287,669

(22) Filed: Oct. 10, 2008

(65) Prior Publication Data

US 2009/0042490 A1 Feb. 12, 2009

Related U.S. Application Data

(60) Division of application No. 11/672,703, filed on Feb. 8, 2007, now Pat. No. 7,503,833, which is a continuation-in-part of application No. 11/449,358, filed on Jun. 8, 2006, now Pat. No. 7,604,529, which is a continuation-in-part of application No. 11/357,481, filed on Feb. 16, 2006, now abandoned.

(51) Int. Cl.
*B24B 1/00* (2006.01)

(52) U.S. Cl. ..... 451/41; 451/59; 451/287; 451/527; 451/529; 451/533

(58) Field of Classification Search ..... 451/41, 451/59, 60, 63, 285, 286, 287, 288, 290, 451/446, 526, 527, 529, 530, 533, 534
See application file for complete search history.

(56) References Cited

U.S. PATENT DOCUMENTS

| | | | | |
|---|---|---|---|---|
| 5,882,251 | A * | 3/1999 | Berman et al. | 451/527 |
| 5,888,121 | A * | 3/1999 | Kirchner et al. | 451/41 |
| 6,692,338 | B1 * | 2/2004 | Kirchner | 451/41 |
| 6,953,388 | B2 * | 10/2005 | Shimagaki et al. | 451/41 |
| 2004/0226620 | A1 * | 11/2004 | Therriault et al. | 137/825 |
| 2004/0259479 | A1 * | 12/2004 | Sevilla | 451/41 |
| 2006/0052040 | A1 * | 3/2006 | Prasad | 451/41 |

* cited by examiner

*Primary Examiner*—Eileen P. Morgan
(74) *Attorney, Agent, or Firm*—Blake T. Biederman

(57) ABSTRACT

The polishing pad (104) is useful for polishing at least one of magnetic, optical and semiconductor substrates (112) in the presence of a polishing medium (120). The polishing pad (104) includes a three-dimensional network of interconnected unit cells (225). The interconnected unit cells (225) are reticulated for allowing fluid flow and removal of polishing debris. A plurality of polishing elements (208, 308 and 408) form the three-dimensional network of interconnected unit cells (225). The polishing elements (208, 308 and 408) have a first end connected to a first adjacent polishing element at a first junction (209, 309 and 409) and a second end connected to a second adjacent polishing element at a second junction (209, 309 and 409) and having a cross-sectional area (222, 322 and 422) that remains within 30% between the first and the second junctions (209, 309 and 409). The polishing surface (200, 300 and 400) formed from the plurality of polishing elements (208, 308 and 408) remains consistent for multiple polishing operations.

10 Claims, 5 Drawing Sheets

THREE-DIMENSIONAL NETWORK FOR CHEMICAL MECHANICAL POLISHING

CROSS REFERENCE TO RELATED APPLICATION

This is a division of U.S. application Ser. No. 11/672,703, filed Feb. 8, 2007, now U.S. Pat. No. 7,503,833. U.S. application Ser. No. 11/672,703 is a continuation-in-part of U.S. application Ser. No. 11/449,358 filed Jun. 8, 2006, now U.S. Pat. No. 7,604,529 now under petition for reinstatement. U.S. application Ser. No. 11/449,358 is a continuation-in-part of U.S. application Ser. No. 11/357,481 filed Feb. 16, 2006, now abandoned.

BACKGROUND OF THE INVENTION

The present invention relates generally to the field of polishing pads for chemical mechanical polishing. In particular, the present invention is directed to a chemical mechanical polishing pad having a polishing structure useful for chemical mechanical polishing magnetic, optical and semiconductor substrates.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

The interaction among polishing layers, polishing media and wafer surfaces during CMP has been the subject of increasing study, analysis, and advanced numerical modeling in the past ten years in an effort to optimize polishing pad designs. Most of the polishing pad developments since the inception of CMP as a semiconductor manufacturing process have been empirical in nature, involving trials of many different porous and non-porous polymeric materials. Much of the design of polishing surfaces, or layers, has focused on providing these layers with various microstructures, or patterns of void areas and solid areas, and macrostructures, or arrangements of surface perforations or grooves, that are claimed to increase polishing rate, improve polishing uniformity, or reduce polishing defects (scratches, pits, delaminated regions, and other surface or sub-surface damage). Over the years, quite a few different microstructures and macrostructures have been proposed to enhance CMP performance.

For conventional polishing pads, pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". The origin of glazing is plastic flow of the polymeric material due to frictional heating and shear at the points of contact between the pad and the workpiece. Additionally, debris from the CMP process can clog the surface voids as well as the micro-channels through which slurry flows across the polishing surface. When this occurs, the polishing rate of the CMP process decreases, and this can result in non-uniform polishing between wafers or within a wafer. Conditioning creates a new texture on the polishing surface useful for maintaining the desired polishing rate and uniformity in the CMP process.

Conventional polishing pad conditioning is achieved by abrading the polishing surface mechanically with a conditioning disk. The conditioning disk has a rough conditioning surface typically comprised of imbedded diamond points. The conditioning disk is brought into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated. The conditioning process as described cuts microscopic furrows into the pad surface, both abrading and plowing the pad material and renewing the polishing texture.

Although pad designers have produced various microstructures and configurations of surface texture through both pad material preparation and surface conditioning, existing CMP pad polishing textures are less than optimal in two important aspects. First, the actual contact area between a conventional CMP pad and a typical workpiece under the applied pressures practiced in CMP is small—usually only a few percent of the total confronting area. This is a direct consequence of the inexactness of conventional surface conditioning that amounts to randomly tearing the solid regions of the structure into tatters, leaving a population of features, or asperities, of various shapes and heights of which only the tallest actually contact the workpiece. Second, the space available for slurry flow to convey away polish debris and heat occupies a thin layer at the pad surface such that polishing waste remains in close proximity with the workpiece until it passes completely out from under the workpiece. Slurry flow between the pad and workpiece must pass across the highly irregular surface and around any asperities that bridge the full vertical distance from the pad to the workpiece. This results in a high probability that the workpiece is re-exposed to both spent chemistry and material previously removed. Thus conventional pad microstructures are not optimal because contact mechanics and fluid mechanics within the surface texture are coupled:

the height distribution of asperities favors neither good contact nor effective fluid flow and transport.

Defect formation in CMP has origins in both shortcomings of conventional pad microstructure. For example, Reinhardt et al., in U.S. Pat. No. 5,578,362, disclose the use of polymeric spheres to introduce texture into a polyurethane polishing pad. Although exact defect formation mechanisms are incompletely understood, it is generally clear that reducing defect formation requires minimizing extreme point stresses on the workpiece. Under a given applied load or polish pressure, the actual point contact pressure is inversely proportional to the true contact area. A CMP process running at 3 psi (20.7 kPa) polish pressure and having 2% real contact area across all asperity tips actually subjects the workpiece to normal stresses averaging 150 psi (1 MPa). Stresses of this magnitude are sufficient to cause surface and sub-surface damage. Being blunt and irregular in shape, asperities on conventional CMP pads also lead to unfavorable flow patterns: localized pressures of fluid impinging on asperities can be significant, and regions of stagnant or separated flow can lead to accumulation of polish debris and heat or create an environment for particle agglomeration.

Beyond providing potential defect formation sources, conventional polishing pad microtexture is not optimal because pad surface conditioning is typically not exactly reproducible. The diamonds on a conditioning disk become dulled with use such that the conditioner must be replaced after a period of time; during its life the effectiveness of the conditioner thus continually changes. Conditioning also contributes greatly to the wear rate of a CMP pad. It is common for about 95% of the wear of a pad to result from the abrasion of the diamond conditioner and only about 5% from contact with workpieces. Thus in addition to defect reduction, improved pad microstructure could eliminate the need for conditioning and allow longer pad life.

The key to eliminating pad conditioning is to devise a polishing surface that is self-renewing, that is, that retains the same essential geometry and configuration as it wears. Thus to be self-renewing, the polishing surface must be such that wear does not significantly reshape the solid regions. This in turn requires that the solid regions not be subjected to continuous shear and heating sufficient to cause a substantial degree of plastic flow, or that the solid regions be configured so that they respond to shear or heating in a way that distributes the shear and heating to other solid regions.

In addition to low defectivity, CMP pad polishing structures must achieve good planarization efficiency. Conventional pad materials require a trade-off between these two performance metrics because lower defectivity is achieved by making the material softer and more compliant, yet these same property changes compromise planarization efficiency. Ultimately, planarization requires a stiff flat material; while low defectivity requires a less stiff conformal material. It is thus difficult to surmount the essential trade-off between these metrics with a single material. Conventional pad structures approach this problem in a variety of ways, including the use of composite materials having hard and soft layers bonded to one another. While composites offer improvements over single-layer structures, no material has yet been developed that achieves ideal planarization efficiency and zero defect formation simultaneously.

Consequently, while pad microstructure and conditioning means exist for contemporary CMP applications, there is a need for CMP pad designs that achieve higher real contact area with the workpiece and more effective slurry flow patterns for removal of polish debris, as well as reducing or eliminating the need for re-texturing. In addition, there is a need for CMP pad structures that combine a rigid stiff structure needed for good planarization efficiency with a less stiff conformal structure needed for low defectivity.

STATEMENT OF THE INVENTION

An aspect of the invention provides a polishing pad useful for polishing at least one of a magnetic, optical and semiconductor substrate in the presence of a polishing medium, the polishing pad comprising: a) a three-dimensional network of interconnected unit cells, the interconnected unit cells being reticulated for allowing fluid flow and removal of polishing debris; b) a plurality of polishing elements forming the three-dimensional network of interconnected unit cells, the interconnected unit cells having a height of at least three unit cells, the polishing elements having a first end connected to a first adjacent polishing element at a first junction and a second end connected to a second adjacent polishing element at a second junction and having a cross-sectional area that remains within 30% between the first and the second junctions; and c) a polishing surface formed from the plurality of polishing elements, the polishing surface having a surface area, measured in a plane parallel to the polishing surface, that remains consistent for multiple polishing operations.

Another aspect of the invention provides a polishing pad useful for polishing at least one of a magnetic, optical and semiconductor substrate in the presence of a polishing medium, the polishing pad comprising: a) a three-dimensional network of interconnected unit cells, the interconnected unit cells having a height of at least ten unit cells, the interconnected unit cells being formed with linear polishing elements and the interconnected unit cells being reticulated for allowing fluid flow and removal of polishing debris; b) a plurality of the linear polishing elements forming the three-dimensional network of interconnected unit cells, the linear polishing elements having a first end connected to a first adjacent polishing element at a first junction and a second end connected to a second adjacent polishing element at a second junction and having a cross-sectional area that remains within 30% between the first and the second junctions; and c) a polishing surface formed from the plurality of polishing elements, the polishing surface having a surface area, measured in a plane parallel to the polishing surface, that remains consistent for multiple polishing operations.

Another aspect of the invention provides a method of polishing at least one of a magnetic, optical and semiconductor substrate with a polishing pad in the presence of a polishing medium, comprising the steps of: creating dynamic contact between the polishing pad and the substrate to polish the substrate, the polishing pad comprising: a three-dimensional network of interconnected unit cells, the interconnected unit cells being reticulated for allowing fluid flow and removal of polishing debris; a plurality of polishing elements forming the three-dimensional network of interconnected unit cells, the interconnected unit cells having a height of at least ten unit cells, the polishing elements having a first end connected to a first adjacent polishing element at a first junction and a second end connected to a second adjacent polishing element at a second junction and having a cross-sectional area that remains within 30% between the first and the second junctions; a polishing surface formed from the plurality of polishing elements, the polishing surface having a surface area, measured in a plane parallel to the polishing surface, that remains consistent for multiple polishing operations; and trapping polishing debris in the polishing elements of the three-dimensional network.

DETAILED DESCRIPTION OF THE INVENTION

Figure 1:
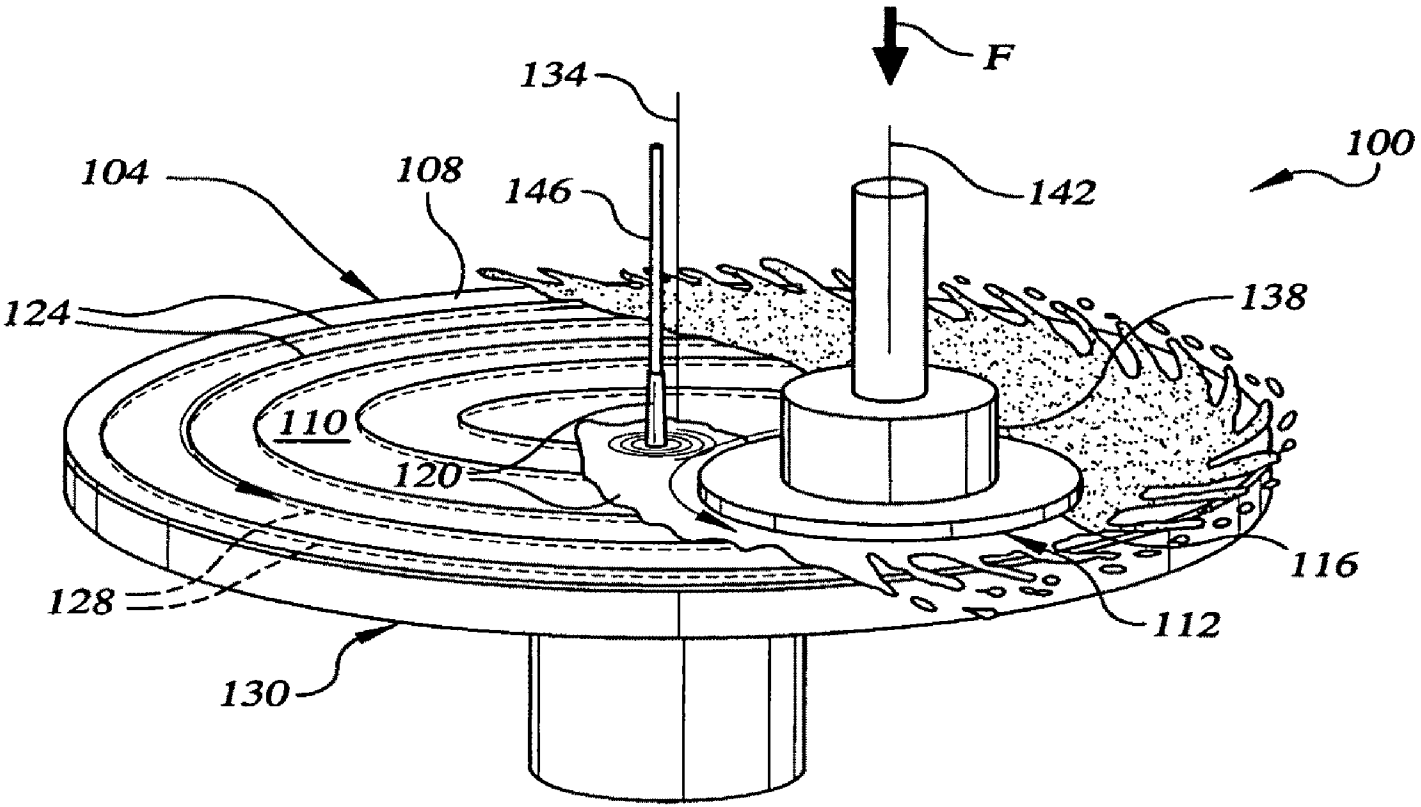
FIG. 1 is a perspective view of a portion of a dual-axis polisher suitable for use with the present invention.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 having a polishing surface 110 for confronting an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. Polishing medium 120 travels through optional spiral groove 124 having a depth 128. For the sake of convenience, the term "wafer" is used below without the loss of generality. In addition, as used in this specification, including the claims, the term "polishing medium" includes particle-containing polishing solutions and non-particle-containing solutions, such as abrasive-free and reactive-liquid polishing solutions.

The present invention generally includes providing polishing layer 108 with a polishing texture 200 (FIG. 2) having a high void fraction or percentage of open volume versus solid volume by forming polishing layer 108 from a series of similar or identical macroscopic or microscopic slender elements, each element constrained at one or more ends, such that the total space occupied by the elements is small relative to the total space available, the spacing of individual elements is small relative to the size of the wafer, and the elements are interconnected in three dimensions to stiffen the network with respect to shear and bending. Preferably, the elements have microscopic dimensions to create a microtexture. These features will be shown to provide both higher real contact area between the pad and wafer and more favorable slurry flow patterns between the pad and wafer than are realized using conventional polishing pads, as well as providing a self-renewing structure that eliminates the need for pad conditioning. In addition, these features will be shown to function in a way that imparts stiffness to the pad at the length scale required for good planarization efficiency while allowing compliance at the shorter length scales required for low defectivity.

Polisher 100 may include polishing pad 104 mounted on platen 130. Platen 130 is rotatable about a rotational axis 134 by a platen driver (not shown). Wafer 112 may be supported by a wafer carrier 138 that is rotatable about a rotational axis 142 parallel to, and spaced from, rotational axis 134 of platen 130. Wafer carrier 138 may feature a gimbaled linkage (not shown) that allows wafer 112 to assume an aspect very slightly non-parallel to polishing layer 108, in which case rotational axes 134, 142 may be very slightly askew. Wafer 112 includes polished surface 116 that faces polishing layer 108 and is planarized during polishing. Wafer carrier 138 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a polishing medium inlet 146 for supplying polishing medium 120 to polishing layer 108.

As those skilled in the art will appreciate, polisher 100 may include other components (not shown) such as a system controller, polishing medium storage and dispensing system, heating system, rinsing system and various controls for controlling various aspects of the polishing process, such as follows: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the magnitude of force F applied between the wafer and polishing pad, and (4) controllers, actuators and selectors for controlling the location of rotational axis 142 of the wafer relative to rotational axis 134 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 134, 142 and polishing medium 120 is dispensed from polishing medium inlet 146 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 112 and polishing pad 104. As those in the art will recognize, it is possible to configure the polishing pad in a web format or into polishing pads having a diameter less than the diameter of the substrate being polished.

Figure 2A:
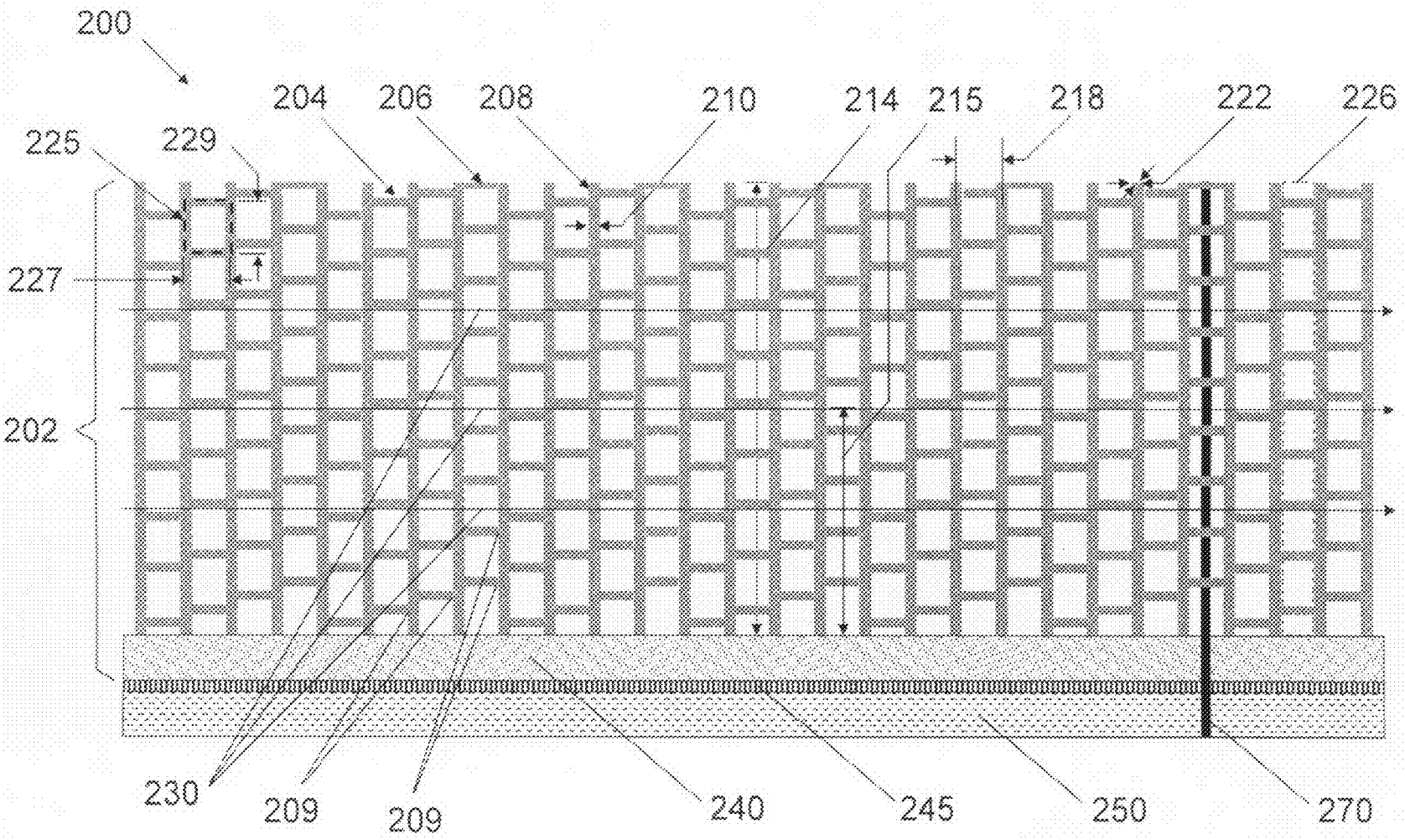
FIG. 2A is a highly enlarged schematic cross-sectional view of the polishing pad of FIG. 1 having a polishing structure according to the present invention.
Figure 2B:
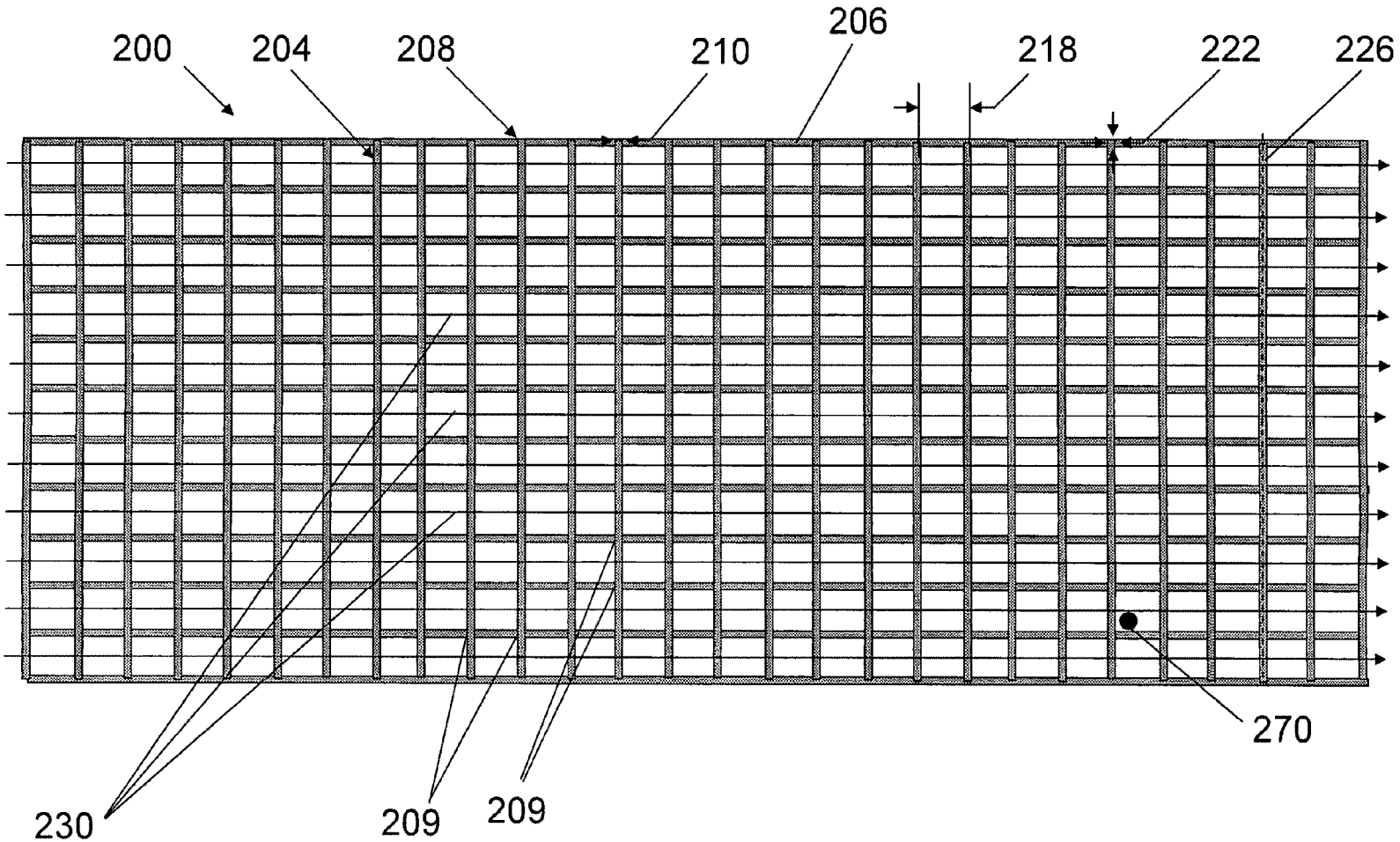
FIG. 2B is a highly enlarged schematic plan view of the polishing pad of FIG. 1 having a polishing structure according to the present invention.

Referring now to FIGS. 2A-2B, embodiments of polishing pad 104 of FIG. 1 will be described in more detail, in particular relative to surface polishing texture 200. In contrast to CMP pads of prior art in which surface texture or asperities are the residue of a material removal or reshaping process (i.e. conditioning), polishing texture 200 is built as a series of identical or similar polishing elements 204 and 208 having a precise geometry. For purposes of illustration, polishing texture 200 is shown to consist of substantially vertical elements 208 and substantially horizontal elements 204, but this need not be the case. Polishing texture 200 is tantamount to a multitude of such polishing elements 204 and 208 each having a mean width 210 and a mean cross-sectional area 222, the elements being spaced at a mean pitch 218. As used here and throughout, the term "mean" designates the arithmetic average taken over the entire volume of the element or structure. In addition, the interconnected network of elements 204, 208 has a mean height 214 and mean half-height 215. The polishing texture 200 is in effect a set of hexahedral unit cells, that is spatial units in which each face (of six) is a square or rectangle and solid members run along the edges only of the spatial unit, leaving the center of each face and of the spatial unit as a whole empty.

The mean height 214 to mean width 210 ratio of elements 208 is at least 0.5. Preferably the mean height 214 to mean width 210 ratio is at least 0.75 and most preferably at least 1. Optionally, the mean height 214 to mean width 210 ratio may be at least 5 or at least 10. As the mean height increases, the number of interconnecting elements 204 required to stiffen the network of polishing elements 208 during polishing increases. In general, only the unconstrained ends of elements 208 projecting beyond the uppermost interconnecting elements 204 are free to flex under shear forces during polishing. The heights of elements 208 between the base layer 240 and the uppermost interconnecting element 204 are highly constrained and forces applied to any one element 208 are effectively carried by many adjacent elements 204 and 208, similar to a bridge truss or external buttressing. In this way polishing texture 200 is rigid at the length scale required for good planarization, but is locally compliant at shorter length scales by virtue of the local deformability and flexibility of the unbuttressed ends of elements 208.

The interconnecting elements 204 and polishing elements 208 combine to form a unit cell 225, the unit cell having a mean width 227 and a mean length 229. These unit cells have a reticulated or open-cell structure that combine to form the three-dimensional network. The interconnect unit cells have a height of at least three unit cells and preferably at least 10 unit cells. Generally, increasing the height of the polishing pad increases the life of the polishing pad as well as its bulk stiffness, the latter contributing to improved planarization. Optionally, the unit cell's mean width 227 does not equal its mean length 229. For example a mean width to mean length ratio may be of at least 2 or of at least 4 to further improve polishing performance for some polishing applications. For example, unit cells with an extended horizontal length will tend to provide stiffer polishing elements for improved planarization; and unit cells with extended vertical length will tend to have more flexible polishing members for improved defectivity performance.

An advantage of the high mean height to mean width ratio of elements 208 is that the total polishing surface area of sectional area 222 remains constant for an extended period. As shown in FIG. 2A, at any point in the life of polishing layer 202, while most of the contacting area of polishing texture 200 consists of the cross-sections 222 of upright elements 208, all or part of some interconnecting elements 204 will also be in the process of wearing down, and these are designated in particular as contact elements 206. Preferably, the vertical positions of interconnecting elements 204 are staggered such that wear occurring parallel to the base layer 240 encounters only a small fraction of interconnecting elements 204 at a given point in time, and these contact elements 206 constitute a small fraction of the total contacting area. This allows polishing of several substrates with similar polishing characteristics and reduces or eliminates the need to periodically dress or condition the pad. This reduction in conditioning extends the pad's life and lowers its operating cost. Furthermore, perforations through the pad, the introduction of conductive-lined grooves or the incorporation of a conductor, such as conductive fibers, conductive network, metal grid or metal wire, can transform the pads into eCMP ("electrochemical mechanical planarization") polishing pads. These pads' three-dimensional network structure can facilitate fluid flow and maintain a consistent surface structure for demanding eCMP applications. The increased fluid flow improves the removal of spent electrolyte from the eCMP process that can improve uniformity of the eCMP process.

Preferably, no solid material exists within polishing texture 200 that is not contained within polishing elements 204 and 208. Optionally, it is possible to secure abrasive particles or fibers to polishing elements 204 and 208. Correspondingly, no void volume exists within any individual element 204 or 208; all void volume in polishing texture 200 preferably exists between and distinctly outside polishing elements 204 and 208. Optionally, however, polishing elements 204 and 208 may have a hollow or porous structure. Polishing elements 208 are rigidly affixed at one end to a base layer 240 that maintains the pitch 218 and maintains polishing elements 208 in a substantially upright orientation. The orientation of elements 208 is further maintained by interconnecting elements 204 at junctions 209 that connect adjacent polishing elements 204 and 208. The junctions 209 may include an adhesive or chemical bond to secure elements 204 and 209. Preferably, junctions 209 represent an interconnection of the same materials and most preferably a seamless interconnection of the same materials.

It is preferred that width 210 and pitch 218 of the polishing elements 208 be uniform, or nearly so, across all polishing elements 208 from end to end between junctions 209, or uniform across subgroups of polishing elements 208. For example, preferably polishing elements 208 have a width 210 and pitch 218 that remain within 50% of the average width or pitch, respectively, in the polishing layer 202 between contact member 206 and half height 215. More preferably, polishing elements 208 have a width 210 and pitch 218 that remain within 20% of the average width or pitch, respectively, in the polishing layer 202 between contact member 206 and half height 215. Most preferably, polishing elements 208 have a width 210 and pitch 218 that remain within 10% of the average width or pitch, respectively, in the polishing layer 202 between contact member 206 and half height 215. In particular, maintaining cross-sectional area of polishing elements 204 and 208 between adjacent junctions 209 to within 30% facilitates consistent polishing performance. Preferably, the pad maintains cross sectional area to within 20% and most preferably to within 10% between adjacent junctions 209. Furthermore, polishing elements 204 and 208 preferably have a linear shape to further facilitate consistent polishing. A direct consequence of these features is that the cross-sectional area 222 of the polishing elements 208 does not vary considerably in the vertical direction. Thus as polishing elements 208 are worn during polishing and the height 214 decreases, there is little change in the area 222 presented to the wafer. This consistency in surface area 222 provides for a uniform polishing texture 200 and allows consistent polishing for repeated polishing operations. For example, the uniform structure allows polishing of multiple patterned wafers without adjusting the tool settings. For purposes of this specification, the polishing surface or texture represents 200 the surface area of polishing elements 204 and 208 measured in a plane parallel to the polishing surface. Preferably the total cross sectional area 222 of polishing elements 208 remains within 25 percent between the initial polishing surface or contact elements 206 and the half-height 215 of the vertical column of unit cells 225. Most preferably, the total cross sectional area 222 of polishing elements 208 remains within 10 percent between the initial polishing surface and the half-height 215 of the vertical column of unit cells 225. As noted previously, it is further preferable that the vertical positions of interconnecting elements 204 are staggered to minimize the change in total cross sectional area as the elements wear down.

Optionally, it is possible to arrange polishing elements 208 in spaced groupings of several polishing elements 208—for example, the polishing elements may comprise circular groupings surrounded by areas free from polishing elements. Within each grouping, it is preferred that interconnecting elements 204 be present to maintain the spacing and effective stiffness of the groupings of elements 208. In addition, it is possible to adjust the density of the polishing elements 204 or 208 in different regions to fine tune removal rates and polishing or wafer uniformity. Furthermore, it is possible to arrange the polishing elements in a manner that forms open channels, such as circular channels, X-Y channels, radial channels, curved-radial channels or spiral channels. The introduction of the optional channels facilitates removal of large debris and can improve polishing or wafer uniformity.

It is preferable that height 214 of polishing elements 208 be uniform across all elements. It is preferred that height 214 remains within 20% of the average height, more preferably, remains within 10% of the average height, and even more preferably, remains within 1% of the average height within polishing texture 200. Optionally, a cutting device, such as a knife, high-speed rotary blade or laser may periodically cut the polishing elements to a uniform height. Furthermore, the diameter and speed of the cutting blade can optionally cut the polishing elements at an angle to alter the polishing surface. For example cutting polishing elements having a circular cross section at an angle will produce a texture of polishing tips that interact with the substrate. Uniformity of height ensures that all polishing elements 208 of polishing texture 200, as well as all interconnecting contact elements 206 in the plane of wear, have the potential to contact the workpiece. In fact, because industrial CMP tools have machinery to apply unequal polish pressure at different locations on the wafer, and because the fluid pressure generated under the wafer is sufficient to cause the wafer to depart from a position that is precisely horizontal and parallel to the mean level of the pad, it is possible that some polishing elements 208 do not contact the wafer. However in any regions of polishing pad 104 where contact does occur, it is desired that as many polishing elements 208 as possible be of sufficient height to provide contact. Furthermore, since the unbutressed ends of polishing elements 208 will typically bend with the dynamic contact mechanics of polishing, an initial polish surface area will typically wear to conform to the bend angle. For example, an initial circular top surface will wear to form an angled top surface and the changes in direction experienced during polishing will create multiple wear patterns.

The dimensions and spacing of polishing elements 204 and 208 are chosen to provide both high contact area 222 between the pad and wafer and adequate open flow area 226 for slurry to remove polish debris. Typically, the polishing elements 204 and 208 constitute less than 80 percent of the polishing pad volume measured above the base layer 240. Preferably the polishing elements 204 and 208 constitute less than 75 percent of the polishing pad volume measured above the base layer 240. For example, typically elements 204 and 208 will occupy 5 to 75 percent of the polishing pad volume measured above the base layer 240. Polishing pads designed for high contact area typically occupy 40 to 80 percent of the polishing pad volume measured above the base layer 240. There is an intrinsic trade-off between these objectives: adding more polishing elements 204 and 208 in the available space of polishing texture 200 augments the total contact area 222 but reduces the flow area 226 creating more obstacles to slurry flow 230 and the removal of polish debris. An essential feature of the present invention is that polishing elements 204 and 208 be sufficiently slender and widely spaced to allow a favorable balancing of contact area and flow area. Polishing elements 208 with rectangular or square cross-sections are advantageous for increasing contact area. Pursuant to this balance, the ratio of the pitch 218 of polishing elements 208 to the width 210 of polishing elements 208 may optionally be at least 2. With these limits, the contact area 222 of polishing texture 200 may reach 75% (that is, the square of one minus the width/pitch ratio) or greater and the flow area 226 is 50% of the available area (that is, one minus the width/pitch ratio) or greater. Typically, polishing elements 208 act to collect or trap polishing debris at a location below the surface of the pad. This feature facilitates a decrease in defectivity by trapping harmful debris in a location that will not contact or scratch the surface of an article during polishing. It is further possible that the ratio of the height 214 to the width 210 of the polishing elements 208 may optionally be at least four 4, to maximize the flow area 226 and allow polish debris to be conveyed horizontally among the polishing elements 204 and 208 while still providing vertical distance between this conveyed debris and the wafer.

Polishing texture 200 is further optimized by choosing the cross-sectional shape of polishing elements 204 and 208 to be streamlined with respect to slurry flow 230 that occurs predominantly in the horizontal direction. Streamlining of bodies to achieve minimum fluid drag is a well-established discipline of engineering and forms part of the science routinely applied in the design of aircraft, watercraft, automobiles, projectiles, and other objects that move in or relative to a gas or liquid. The equations of fluid flow governing these latter human-scale objects apply identically at the scale of CMP pad macrostructure or microstructure. In essence streamlining consists in choosing a gradually curved cross-section free of sharp transitions such that an external fluid flow may pass around the cross-section without separating from the surface and forming recirculating eddies that consume fluid energy. Pursuant to this consideration, a circular cross-section 222 is preferred over a square or rectangular cross-section for polishing elements 204 and 208. Further streamlining of the shapes of polishing elements 208 requires knowledge of the local direction of the slurry flow 230. Since both the pad and wafer are rotating, the slurry flow 230 may approach the polishing elements 204 and 208 from a variety of angles and the correct streamlining for one angle of approach will be sub-optimal for other angles of approach. The only shape that is streamlined equally to all directions of fluid approach is a circular cross-section, thus it is preferred in the general case. If the dominant flow direction can be determined, as in the case of a CMP process having a very high ratio of platen speed to carrier speed, it is more preferred to streamline the cross-section of polishing elements 204 and 208 with respect to that direction.

As shown in FIG. 2A, polishing pad 104 includes polishing layer 202 and may include in addition a subpad 250. It is noted that subpad 250 is not required and polishing layer 202 may be secured directly, via base layer 240, to a platen of a polisher, e.g., platen 130 of FIG. 1. Polishing layer 202 may be secured, via base layer 240, to subpad 250 in any suitable manner, such as adhesive bonding, e.g., using a pressure sensitive adhesive layer 245 or hot-melt adhesive, heat bonding, chemical bonding, ultrasonic bonding, etc. The base layer 240 or subpad 250 may serve as the polishing base for attachment of the polishing elements 208. Preferably, a base portion of polishing elements 208 extends into base layer 240.

Various methods of manufacture are possible for polishing texture 200. For larger-scale networks, these include micromachining, laser or fluid-jet etching, and other methods of material removal from a starting solid mass; and focused laser polymerization, preferential optical curing, biological growth, and other methods of material construction within an initially empty volume. For smaller-scale networks, crystallization, seed polymerization, lithography or other techniques of preferential material deposition may be employed, as well as electrophoresis, phase nucleation, or other methods of establishing a template for subsequent material self-assembly.

The polishing elements 204 and 208 and base layer 240 of microstructure 200 may be made of any suitable material, such as polycarbonates, polysulfones, nylons, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and mixtures thereof. Polishing elements 204 and 208 and base layer 240 may also be made of a non-polymeric material such as ceramic, glass, metal, stone, wood, or a solid phase of a simple material such as ice. Polishing elements 204 and 208 and base layer 240 may also be made of a composite of a polymer with one or more non-polymeric materials.

In general, the choice of material for polishing elements 204 and 208 and base layer 240 is limited by its suitability for polishing an article made of a particular material in a desired manner. Similarly, subpad 250 may be made of any suitable material, such as the materials mentioned above for polishing elements 204 and 208 and base layer 240. Polishing pad 104 may optionally include a fastener for securing the pad to a platen, e.g., platen 130 of FIG. 1, of a polisher. The fastener may be, e.g., an adhesive layer, such as a pressure sensitive adhesive layer 245, hot melt adhesive, a mechanical fastener, such as the hook or loop portion of a hook and loop fastener. It is also within the scope of the invention to implement one or more fiber-optic endpointing devices 270 or similar transmission devices that occupy one or more of the void spaces of polishing texture 200.

Figure 3:
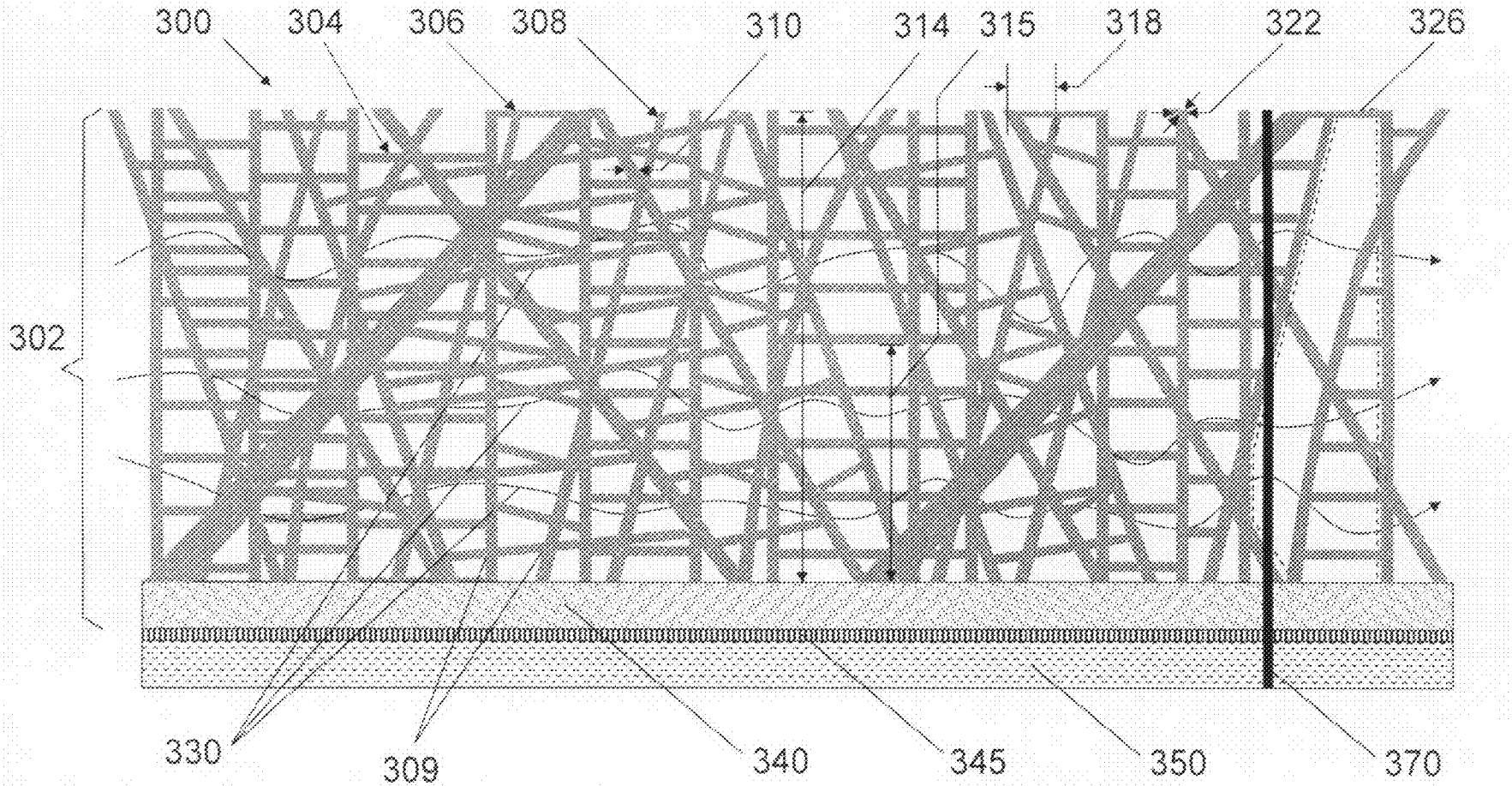
FIG. 3 is a highly enlarged schematic cross-sectional view of an alternative polishing pad polishing structure of the present invention.

With reference to FIG. 3, a second embodiment of polishing pad 104 of FIG. 1 consistent with the present invention is described with respect to an alternative surface polishing texture 300—a side cross-sectional view of FIG. 3 would have a similar asymmetrical pattern of interconnected reticulated unit cells within polishing layer 302. Similar to the pad of FIG. 2A, adhesive layer 345 secures base layer 340 to optional subpad 350; and optionally includes endpointing device 370. Polishing texture 300 differs from polishing texture 200 of FIG. 2A in three aspects. First, the elements 308 of polishing texture 300 are not strictly vertical but are positioned at a variety of angles between 45 and 90 degrees with respect to the base layer 340 and the horizontal plane, and a few of the elements 308 are curved rather than straight. Also, the interconnecting elements 304 are not all horizontal but some are positioned at angles of 0 to 45 degrees with respect to the base layer 340 and the horizontal plane. As such, polishing texture 300 consists of unit cells, but the cells vary in shape and number of faces. These features nonwithstanding, height 314 of elements 308 does not vary substantially within polishing texture 300 between the polishing layer or polishing element 306 and the half height 315 of the polishing texture 300. Second, there is more variation in the width 310, pitch 318, and cross-sectional area 322 among elements 304 and 308 than in the corresponding attributes of polishing elements 208. Third, the slurry flow 330 through and among elements 304 and 308 follows more irregular paths than the flow 230 through polishing elements 208. Nonetheless, polishing texture 300 embodies the essential properties of the present invention where elements 306 form the polishing surface. In particular, the elements 304 and 308 interconnect at junctions 309 to form a network interconnected in three dimensions to a sufficient degree to impart stiffness to the polishing texture as a whole, while the unbuttressed ends of elements 308 provide local flexibility to conform to a workpiece. In addition, the elements 304 and 308 are still sufficiently slender and widely spaced to allow a favorable balancing of contact area and flow area; the ratio of the mean pitch 318 of elements 308 to the mean width 310 of elements 308 is at least 2 and the ratio of the height 314 to the mean width 310 of the elements 308 is at least 4. As such, the contact area 322 of polishing texture 300 may reach 25% or greater and the flow area 326, while more irregular than flow area 326 of polishing texture 300, is large enough to allow polish debris to be conveyed horizontally among the elements 304 and 308 while still providing vertical distance between this conveyed debris and the wafer.

The polishing texture 300 of FIG. 3 illustrates that the present invention comprehends open interconnected networks in which individual elements are positioned at all angles from fully horizontal to fully vertical. By extension, the invention comprehends entirely random arrays of interconnected slender elements in which there is no clearly repeating size or shape to the void spaces, or where many elements are highly curved, branched, or entangled. Familiar images that, as polishing pad microstructures, would fall within the scope of the invention are bridge trusses, stick models of macromolecules, and interconnected human nerve cells. In each case the structure must possess the same critical features, namely that sufficient interconnection in three dimensions is present to stiffen the overall network, that a wearing of the network in a horizontal plane from the top surface produces slender elements having locally unbuttressed ends that provide compliance with a workpiece over short length scales, and that the open void space and length to width ratio of the elements conform to the geometric limits given previously.

Figure 4:
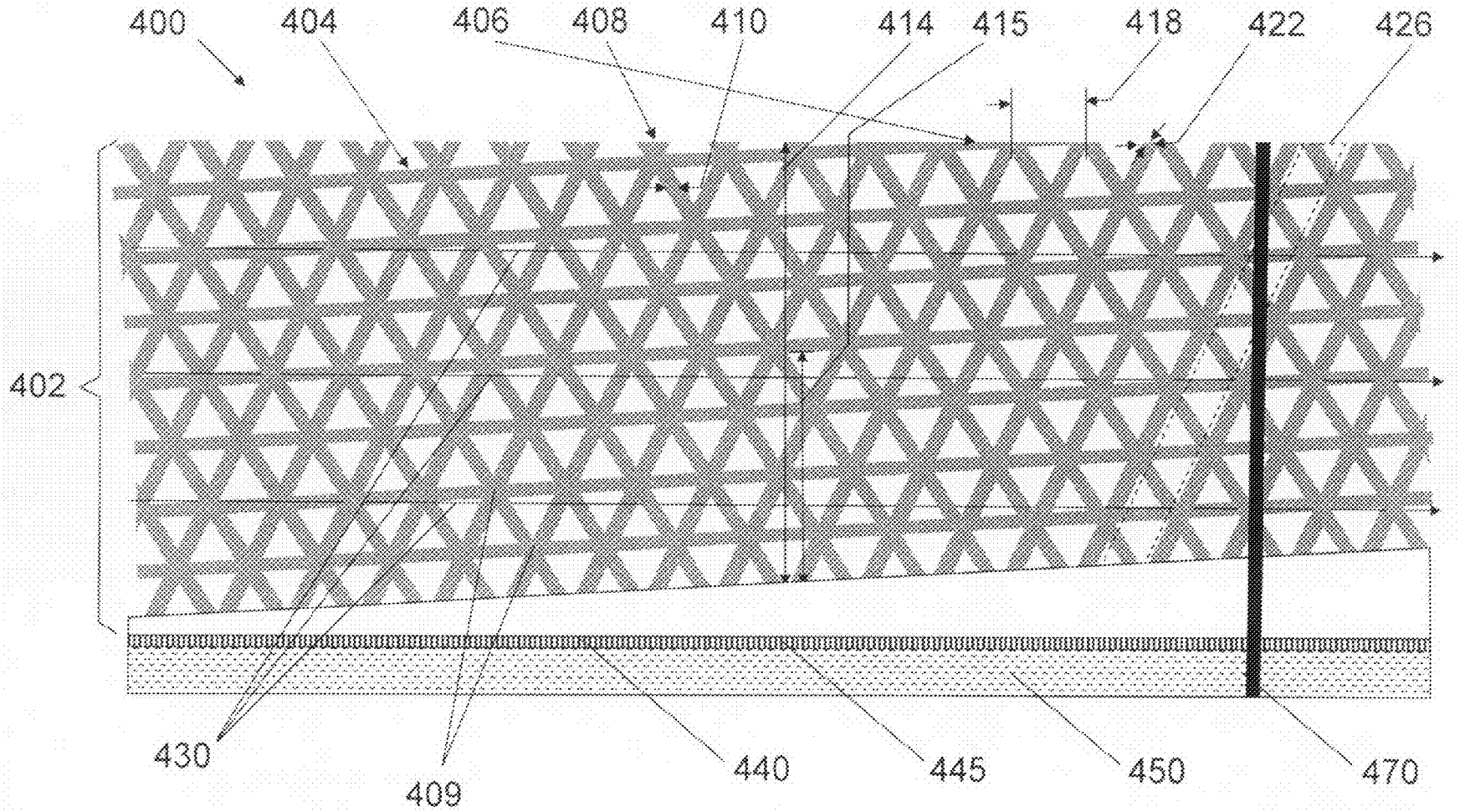
FIG. 4 is a highly enlarged schematic cross-sectional view of another alternative polishing pad polishing structure of the present invention.

An additional embodiment of the invention is shown in FIG. 4 and consists of polishing layer 402 having a regular-spaced interconnected tetrahedral lattice. All elements 404 and 408 are shown as identical in length and width that join at junctions 409, though this need not be so. In the embodiment shown, the unit cell is a regular tetrahedron in which each (of four) faces is an equilateral triangle, the side of which is the pitch 418 of the network, and solid members having a width 410 run along only the four edges of the spatial unit, leaving the center of each triangular face and of the spatial unit as a whole empty. Because of the symmetry of the tetrahedral lattice, a side cross-sectional and plan view of FIG. 4 would form the same reticulated pattern. This polishing texture provides the highest possible stiffness because triangularly faceted polyhedra are non-deformable. As the structure wears, free ends are formed on elements 408 that provide local deformability and compliance to the workpiece. In the embodiment shown in FIG. 4, the tetrahedral network is constructed on a slightly wedge-shaped base layer 440 so that no planes of the network are positioned exactly parallel to the plane of contact with the wafer. At a given point in time only a subset of members 406 are wearing along their longest dimension, while most of the area of contact is provided by the smaller cross sectional areas 422 of elements wearing across their shorter dimensions. This provides the feature that the contact area remains essentially invariant over the height 414 between the polishing layer or polishing element 406 and the half height 415 of the polishing texture 400. Across the wedge-shaped base layer 440, the mean area 426 for slurry flow 430 varies slightly. To minimize this variation, in practice base layer 440 is stepped such that a repeating series of wedge-shaped sections supports the network. The structure shown in FIG. 4 is approximately one repeating unit. Similar to the pad of FIG. 2A, adhesive layer 445 secures base layer 440 to optional subpad 450; and optionally includes end-pointing device 470.

The invention provides the advantage of decoupling contact mechanics from fluid mechanics. In particular, it allows effective fluid flow within the pad to easily remove polishing debris. In addition, it allows adjustment of the polishing elements' stiffness, height and pitch to control contact mechanics with a substrate. Furthermore, the polishing elements' shape allows the reduction or elimination of conditioning for increased polishing pad life. Finally, the uniform cross sectional area allows polishing of multiple substrates, such as patterned wafers with similar polishing characteristics.

The invention claimed is:

1. A polishing pad useful for polishing at least one of a magnetic, optical and semiconductor substrate in the presence of a polishing medium, the polishing pad comprising:

a) a three-dimensional network of interconnected unit cells, the interconnected unit cells being reticulated for allowing fluid flow and removal of polishing debris;

b) a plurality of horizontal and vertical polishing elements forming the three-dimensional network of interconnected unit cells, the interconnected unit cells having a height of at least three unit cells, the horizontal and vertical polishing elements having a first end connected to a first adjacent polishing element at a first junction and a second end connected to a second adjacent polishing element at a second junction and having a cross-sectional area between the first and the second junctions; and c) a polishing surface formed from the plurality of horizontal and vertical polishing elements, the polishing surface having a surface area, measured in a plane parallel to the polishing surface, that remains consistent for multiple polishing operations.

2. The polishing pad according to claim 1, wherein the plurality of horizontal and vertical polishing elements constitute 5 to 75 percent of polishing pad volume.

3. The polishing pad according to claim 1, wherein a total cross sectional area of the polishing surface varies less than 25 percent between an initial total cross sectional area and a half-height of the interconnected unit cells.

4. The polishing pad according to claim 1, wherein a total cross sectional area of the polishing surface varies less than 10 percent between an initial total cross sectional area and a half-height of the interconnected unit cells.

5. The polishing pad according to claim 1, wherein cross-sectional areas of the plurality of horizontal and vertical polishing elements are rectangular.

6. The polishing pad according to claim 1, wherein cross-sectional areas of the plurality of horizontal and vertical polishing elements are streamlined with respect to fluid flow in a plane of cross-sectional area of the plurality of horizontal and vertical polishing elements.

7. A polishing pad useful for polishing at least one of a magnetic, optical and semiconductor substrate in the presence of a polishing medium, the polishing pad comprising:

a) a three-dimensional network of interconnected unit cells, the interconnected unit cells having a height of at least ten unit cells, the interconnected unit cells being formed with horizontal and vertical polishing elements and the interconnected unit cells being reticulated for allowing fluid flow and removal of polishing debris;

b) a plurality of the horizontal and vertical polishing elements forming the three-dimensional network of interconnected unit cells, the horizontal and vertical polishing elements having a first end connected to a first adjacent polishing element at a first junction and a second end connected to a second adjacent polishing element at a second junction and having a cross-sectional area that remains within 30% between the first and the second junctions; and c) a polishing surface formed from the plurality of horizontal and vertical polishing elements, the polishing surface having a surface area, measured in a plane parallel to the polishing surface, that remains consistent for multiple polishing operations.

8. The polishing pad according to claim 7, wherein the horizontal and vertical polishing elements of the three-dimensional network bend at a polishing layer of the three-dimensional network during polishing.

9. A method of polishing at least one of a magnetic, optical and semiconductor substrate with a polishing pad in the presence of a polishing medium, comprising the steps of:

creating dynamic contact between the polishing pad and the substrate to polish the substrate, the polishing pad comprising: a three-dimensional network of interconnected unit cells, the interconnected unit cells being reticulated for allowing fluid flow and removal of polishing debris; a plurality of horizontal and vertical polishing elements forming the three-dimensional network of interconnected unit cells, the interconnected unit cells having a height of at least ten unit cells, the horizontal and vertical polishing elements having a first end connected to a first adjacent polishing element at a first junction and a second end connected to a second adjacent polishing element at a second junction and having a cross-sectional area between the first and the second junctions; a polishing surface formed from the plurality of horizontal and vertical polishing elements, the polishing surface having a surface area, measured in a plane parallel to the polishing surface, that remains consistent for multiple polishing operations; and trapping polishing debris in the horizontal and vertical polishing elements of the three-dimensional network.

10. The method of claim 9 wherein the dynamic contact polishes a series of patterned semiconductor wafers.

* * * * *